United States Patent [19]

Iai

[11] Patent Number: 4,550,477

[45] Date of Patent: Nov. 5, 1985

[54] APPARATUS FOR FORMING AND PLANTING SLIDE FASTENER ELEMENTS

[75] Inventor: Kenichiro Iai, Toyama, Japan

[73] Assignee: Yoshida Kogyo K.K., Tokyo, Japan

[21] Appl. No.: 566,997

[22] Filed: Dec. 30, 1983

Related U.S. Application Data

[63] Continuation of Ser. No. 296,822, Aug. 27, 1981, abandoned.

[30] Foreign Application Priority Data

Sep. 25, 1980 [JP] Japan ..... 55-133478

[51] Int. Cl.[4] ..... B21D 53/56

[52] U.S. Cl. ..... 29/33.2; 29/34 A; 29/769

[58] Field of Search ..... 29/33.2, 34 A, 767, 29/766, 769, 56.5, 33 R, 566.1, 408

[56] References Cited

U.S. PATENT DOCUMENTS

| | | | |
|---|---|---|---|
| 2,141,200 | 12/1938 | Sundback | 29/33.2 |
| 2,355,836 | 10/1945 | Norkin | 29/33.2 |
| 2,744,560 | 5/1956 | Johnsehl | 29/33.2 |
| 2,763,051 | 9/1956 | Firing | 29/34 A |
| 2,804,677 | 9/1957 | Poux | 29/34 A |
| 2,989,444 | 6/1961 | Cohn | 29/769 |
| 2,989,751 | 6/1961 | Scheuermann | 29/33.2 |
| 3,415,293 | 12/1968 | Pearlman | 29/33.2 X |

FOREIGN PATENT DOCUMENTS

| | | | |
|---|---|---|---|
| 467016 | 9/1966 | Japan | 29/33.2 |

*Primary Examiner*—William R. Briggs

*Attorney, Agent, or Firm*—Hill, Van Santen, Steadman & Simpson

[57] ABSTRACT

Disclosed herein is an apparatus for forming and planting fastener elements comprising a ram mounted on a frame for reciprocal movement and having a cutting die provided with a passage for a wire to be used for elements and a forming die for forming an engageable head in an element, a cutting punch for cutting out an element from the wire, a forming punch for forming the engageable head in cooperation with the forming die and at least one side punch for planting the element on a fastener tape. The apparatus is characterized in that cam means for driving the ram, forming punch and side punch are formed on a common output drive shaft and arranged so that the ram dwells for a predetermined time at the end of each forward and backward movement and the side punch secures the element to the tape during the dwell of the ram at the end of its forward movement and the forming punch is actuated during the dwell of the ram at the end of its backward movement.

3 Claims, 15 Drawing Figures

Fig. 9
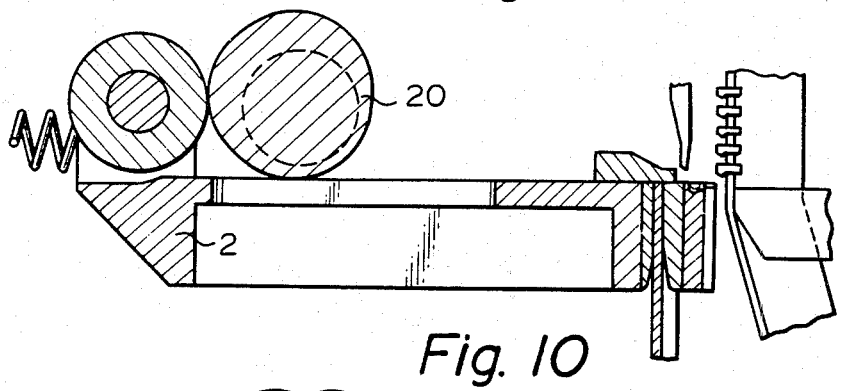
Fig. 10
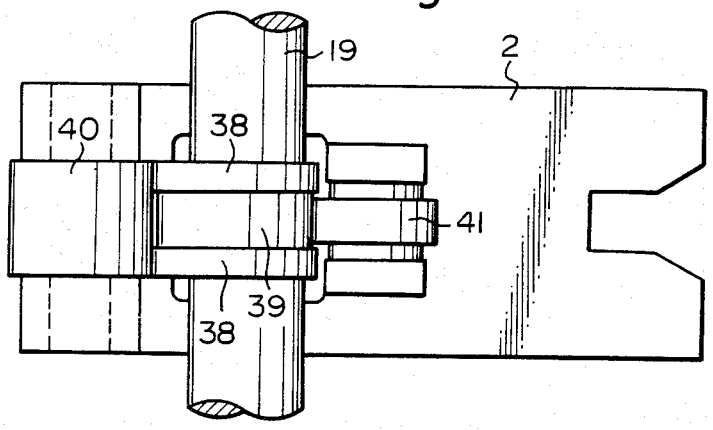
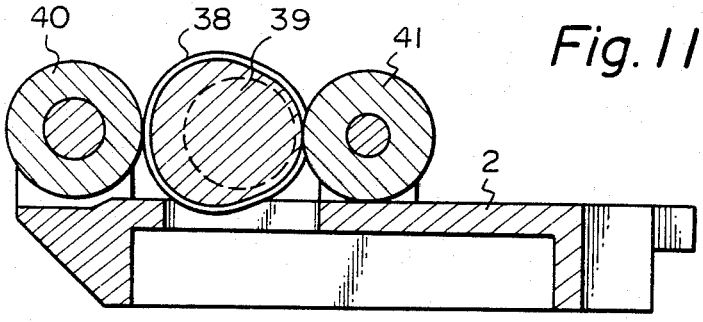
Fig. 11

APPARATUS FOR FORMING AND PLANTING SLIDE FASTENER ELEMENTS

This is a continuation of application Ser. No. 296,822, filed Aug. 27, 1981, abandoned.

BACKGROUND OF THE INVENTION

This invention relates to an apparatus for forming and planting slide fastener elements. More particularly, the invention relates to an apparatus for forming and planting slide fastener elements in which elements are cut out from a formed wire and are successively secured to a fastener tape after they are formed with engageable heads to form a slide fastener stringer.

In apparatuses of this kind, a ram is mounted for reciprocal movement in a horizontal direction. The ram is provided at the forward end thereof with a forming die for forming the head of an element and a passage for guiding a formed wire. When the ram moves backward, an element is cut out from the formed wire by a cutting punch mounted for relative movement in the horizontal direction with respect to the ram. The cut-out element is received in the forming die when the ram reaches the end of its backward movement. At the end of the ram's backward movement, a forming punch disposed above the forming die descends to form an engageable head in the element. Then the ram advances to a position in which the legs of the element receive a side portion of a fastener tape therebetween, where the element is planted onto the tape by squeezing the legs onto the tape using side punches.

Apparatuses of this kind are disclosed in Japanese Pat. Publication No. 7016/71 and U.S. Pat. Nos. 2,763,051 and 2,804,677.

SUMMARY OF THE INVENTION

An object of this invention is to provide an apparatus for forming and planting slide fastener elements which can operate at higher speeds and more reliably than conventional apparatuses without using complicated mechanisms and devices.

According to this invention, an apparatus for forming and planting elements comprises a ram mounted for reciprocal movement which is driven by cam means formed on an output drive shaft so that the ram dwells for a certain time at the end each forward and backward movement. An engageable head is formed on an element when the ram dwells at the end of its backward movement and the element is planted onto a tape when the ram dwells at the end of its forward movement. Therefore, it is unnecessary to synchronize the operation of a forming punch and side punches with the moving ram. Therefore, the operation for forming the engageable head of the element and planting the element may be done reliably without using a complicated mechanism. Furthermore, the ram begins retraction after the tape having elements secured thereto is fed upward an appropriate distance. Therefore, even when the apparatus is running at speed, the element secured to the tape does not catch on the forming die retracting with the ram to disorder the accurate securement of the element. The forming punch and the side punches are also driven by cam means formed on the same output drive shaft on which the cam means for the ram is formed. Therefore, the timing of the ram, the forming punch and the side punch operations is kept accurate although their driving mechanisms are simple. Because of the features mentioned above, the apparatus of this invention is very reliable even when operating at high speed.

BRIEF DESCRIPTION OF THE DRAWINGS

The above mentioned and other objects and features of this invention will be clear from the following description of embodiments of the invention referring to the drawings, wherein:

FIGS. 6A to 9 are illustrations showing a first ram and associated members in successive steps of operation;

FIG. 10 is a plan view of cam means for driving a first ram and associated rollers in another embodiment of the invention;

FIG. 11 is a sectional view taken along the center of the arrangement shown in FIG. 10;

DETAILED DESCRIPTION OF THE PREFERRED EMBODIMENT

Figure 2:
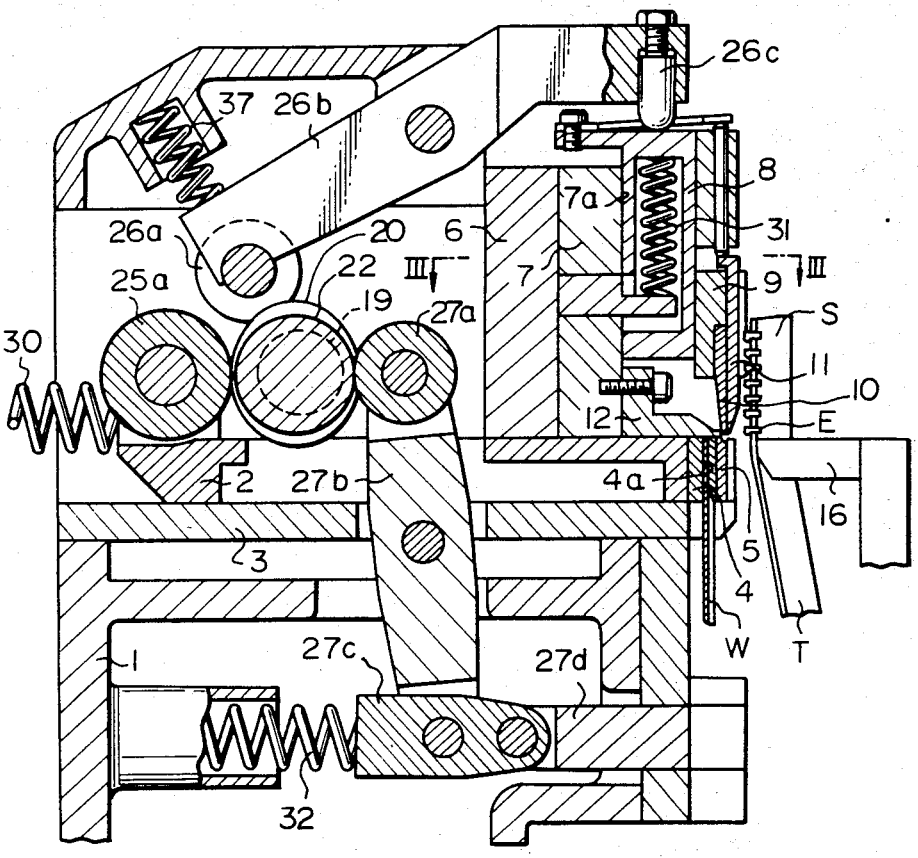
FIG. 2 is a sectional view of an apparatus for forming and planting slide fastener elements according to one embodiment of this invention taken along a vertical plane.

With reference to FIG. 2, an apparatus for forming and planting slide fastener elements according to this invention comprises a frame 1 which supports a first ram 2 in a ram guide 3 for reciprocable movement in a horizontal direction. At the forward end of this first ram 2, there are provided, one after another, in the advance direction of the first ram, a cutting die 4 having a passage 4*a* through which a formed wire W for elements having a cross sectional configuration, such as "Y", extends and a forming die 5 for forming an engageable head in a fastener element E.

Figure 3:
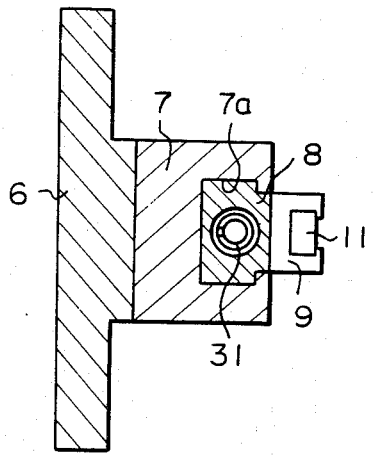
FIG. 3 is a sectional view of the apparatus of FIG. 2 taken along line III—III.
Figure 4:
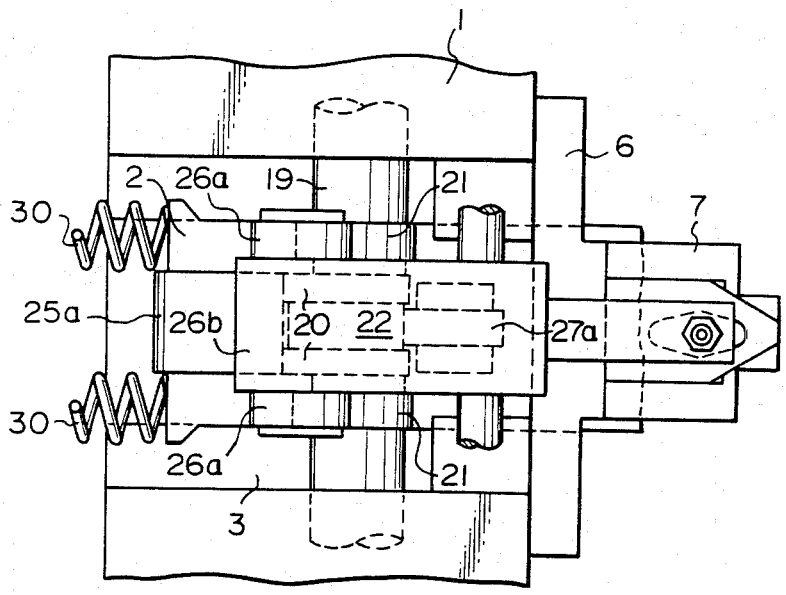
FIG. 4 is a plan view of the apparatus shown in FIG. 2 with deletion of a cover thereof.

The frame 1 has a mounting plate 6 above the forward end of the first ram 2. A ram guide 7 is secured to the mounting plate 6. As shown in FIG. 3, the ram guide 7 is provided with a guide channel 7*a* in which a second ram 8 is received for vertical movement in a direction perpendicular to the horizontal movement of the first ram 2. A forming punch 10 for forming an engageable head of an element E and a pressure pad 11 for holding the both legs of the element E as the engageable head is formed are mounted on the front side of the second ram 8 by a punch holder 9 interposed therebetween. A cutting punch 12 is secured to the lower end portion of the ram guide 7 so that the cutting punch slidably engages the upper surface of the forward end of the first ram 2.

Figure 5:
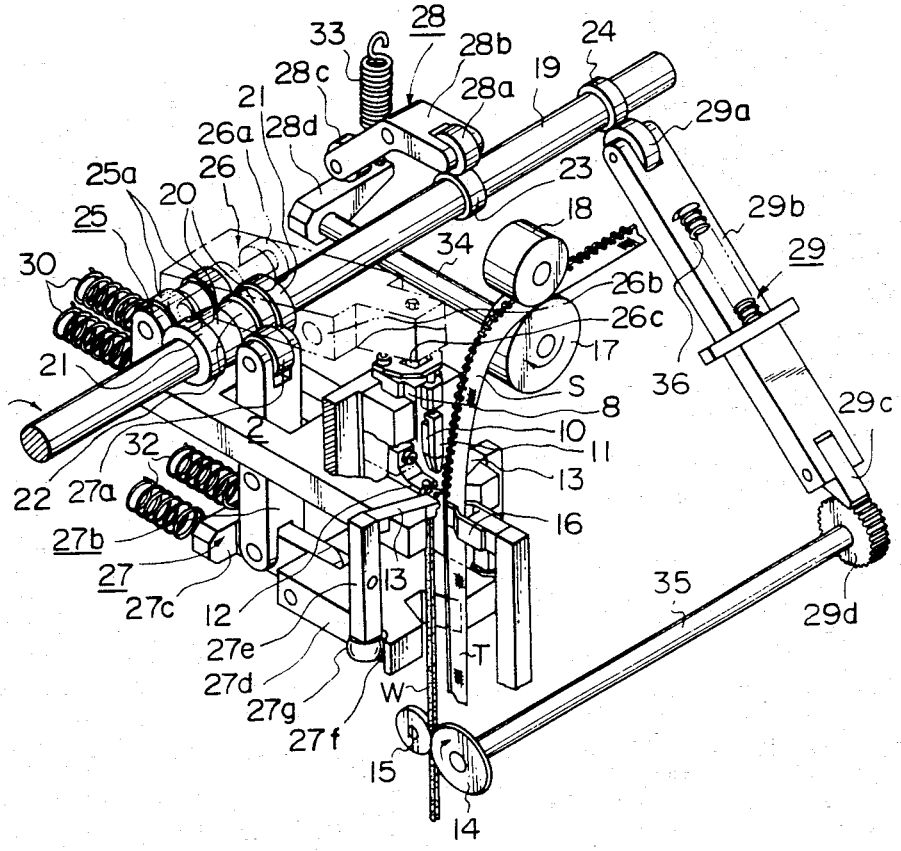
FIG. 5 is a perspective view of operating parts used in the apparatus of FIG. 2.

As shown in FIG. 5, a pair of side punches 13 are provided on the opposite sides of the forming die 5. The side punches plant the element E which has been formed with the engageable head by squeezing both legs of the element onto a tape T.

Figure 1:
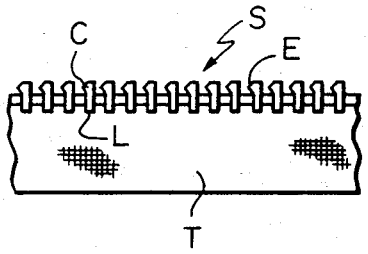
FIG. 1 is a plan view of a portion of a fastener stringer made by an apparatus according to this invention.

As shown in FIGS. 2 and 5, a formed wire W for forming the elements extends through the passage 4a in the cutting die 4 and is fed by a feeding roller 14 and a guide roller 15 intermittently each increment corresponding to the thickness of the element E. Like the formed wire W, the tape is fed from the underside of the apparatus and guided by tape guides 16. The elements E are secured to the tape T to form a slide fastener stringer S as shown in FIG. 1. The stringer is intermittently pulled up by the combination of a stringer feeding roller 17 and a pressure roller 18.

For driving the abovementioned operating members, an output drive shaft 19 is provided above the rear end of the first ram 2. The output drive shaft 19 is formed with first ram drive cams 20, forming punch drive cams 21, a side punch drive cam 22, a stringer feeding cam 23 and a wire feeding cam 24. Each of these cams is connected to respective operating members 2, 10, 13, 14 and 17 through respective cam follower mechanisms 25, 26, 27, 29 and 28 to actuate them.

The cam follower mechanism 25 for the first ram 2 includes rollers 25a rotatably mounted on the rear portion of the first ram 2 for rolling engagement with the cams 20. Compression springs 30 forwardly urge the first ram 2 so that rotation of the cams 20 moves the first ram 2 backward against the force of the springs 30 to horizontally reciprocate it. The shapes of the two cams 20 are identical and are so selected that the first ram 2 dwells at the end of each forward and backward movement for respective predetermined times.

The cam follower mechanism 26 for the forming punch 10 comprises rollers 26a mounted for rolling engagement with the cams 21, a lever 26b pivotally mounted at its central portion on the body of the apparatus and having the rollers 26a rotatably mounted at one end thereof, a pin 26c mounted at the other end of the lever 26b and bearing against the top surface of the second ram 8 and a compression spring 37 for returning the lever 26b. A compression spring 31 is contained in the second ram 8 for upwardly biasing the ram. Therefore, the second ram 8 descends when the lever 26b swings actuated by the cams 21 and the ram 8 returns to its original position by means of the compression spring 31.

The cam follower mechanism 27 for the side punches 13 comprises a roller 27a mounted for rolling engagement with the cam 22, a lever 27b pivotally mounted at the central portion thereof on the frame 1 so that the lever vertically extends, the roller 27 being rotatably mounted on the lever at one end thereof, a link 27c, the central portion of which is pivotally connected to the other end of the lever 27b, a third ram 27d pivotally connected to the forward end of the link 27c and actuating arms 27e swingably supported at the central portion thereof and connected at the upper ends thereof to the side punches 13. As shown in FIG. 5 the side surfaces of the forward end of the third ram 27d function as cam surfaces 27f which go outward as they go forward. Cam follower portions 27g are provided at the lower portion of the actuating arms 27e. The actuating arms 27e are swung by cooperation between the cam surface 27f and the cam follower portions 27gas the third ram 27d moves backward to actuate the side punches 13. Compression springs 32 make the third ram 27d return to its original position.

The cam follower mechanism 28 for feeding the stringer comprises, as shown in FIG. 5, a roller 28a mounted for rolling engagement with the cam 23, a first lever 28b swingably supported at the central portion thereof and having the roller 28a rotatably mounted at one end thereof and a roller 28c rotatably mounted on the other end thereof, and second lever 28d upwardly biased by a tension spring 33 and adapted to downwardly swing by the roller 28c. A transmission shaft 34 of the stringer feeding roller 17 is connected to the base portion of the second lever 28d with a one way clutch (not shown) interposed therebetween so that the stringer feeding roller 17 intermittently rotates only in one direction to advance the stringer S.

The cam follower mechanism 29 for feeding the wire comprises a roller 29a mounted for rolling engagement with the cam 24, a slider 29b having the roller 29a rotatably mounted on one end thereof, a pawl 29c mounted on the other end of the slider 29b, and a ratchet wheel 29d adapted to intermittently rotate each time by a predetermined angle only in one direction by the reciprocal movement of the pawl 29c. A compression spring 36 urges the slider 29b against the cam 24 so that the slide 29b reciprocates as the cam 24 rotates. The ratchet wheel 29d and the wire feeding roller 14 are connected to each other by a transmission shaft 35 so that the wire feeding roller 14 intermittently advances the wire W.

In the power transmitting mechanism using the cams explained above, the shapes and the mutual operation phases of the cams 20, 21, 22, 23 and 24 are so selected that the respective operation steps are timed as shown below with respect to the movement of the first ram 2.

| | position of first ram | | | |
|---|---|---|---|---|
| operation steps | forward dwell | backward movement | backward dwell | forward movement |
| wire feeding | ↔ | | | |
| wire cutting | | ↔ | | |
| head forming | | | ↔ | |
| deformation of element legs | → | | | ← |
| stringer feeding | ← | → | | |

Figure 6A:
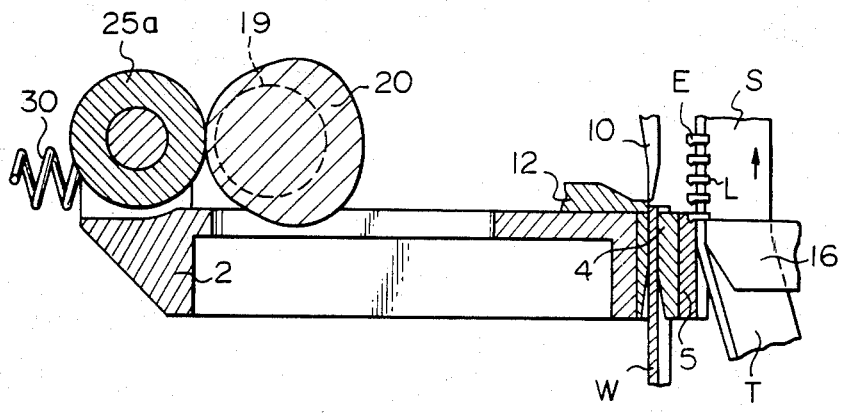
Figure 6B:
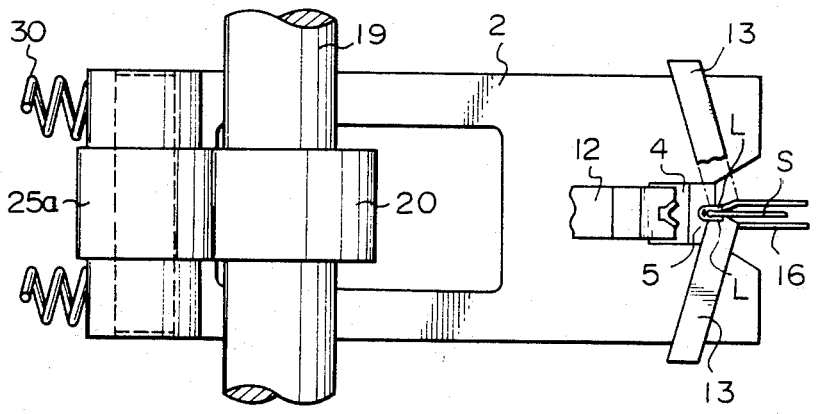

The operation of the apparatus according to the above-described embodiment will be explained. In the situation shown in FIGS. 6A and 6B in which the first ram 2 is in its forward dwell, the formed wire W has been advanced so that it projects by a predetermined amount corresponding to the thickness of one element E above the cutting die 4. In the first half of this dwell time, planting of the element E on the tape T is completed. The slide fastener stringer S is pulled upward immediately after the securement of the element is finished and the side punches 13 are retracted from the element legs L. The first ram 2 moves backward after the upward movement of the stringer S removes the engageable head C of the lastly secured element E from the forming die 5. Therefore, it never happens that the planted element hitches on the forming die 5 retracting together with the first ram 2.

Figure 7:
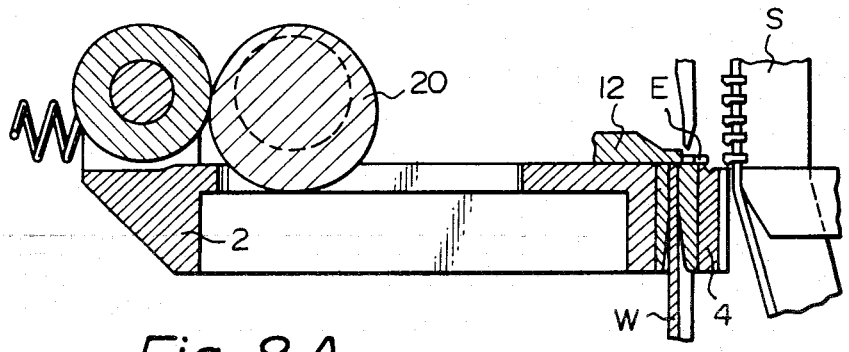

Then, the formed wire W is cut as the first ram 2 moves backward as shown in FIG. 7. During this retraction of the first ram, the upward feeding of the stringer is completed. The formed wire W is cut during the backward movement of the first ram 2 in which the ram is positively driven by the cams 20. Therefore, the cutting of the wire is done reliably.

Figure 8A:
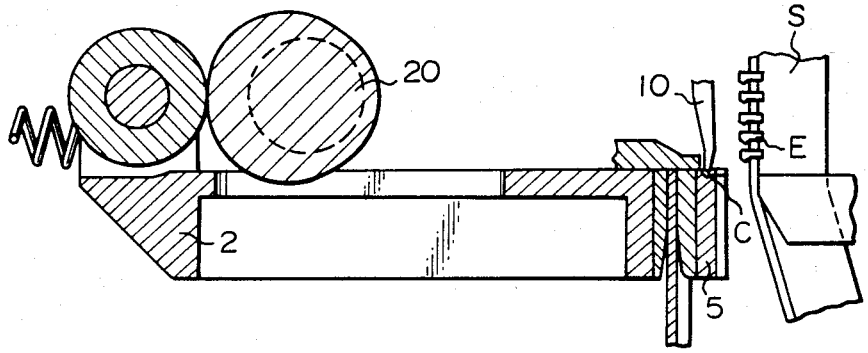
Figure 8B:
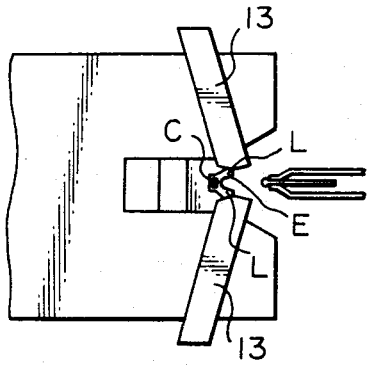

As the first ram 2 reaches the end of its backward movement, the cut-out element is received in the forming die 5 and the forming punch 10 which aligns the forming die 5 in this position descends as shown in FIG. 8A so that the engageable head C is formed as the first ram 2 is in the backward dwell. As shown in FIG. 8B, the side punches 13 start their operation when the first ram is in the backward dwell so that they engage the element E at the opposite outer sides of the legs L.

FIG. 9 shows the first ram 2 on the way of the forward movement. At this time, side punches 13 begin deformation of the legs L of the element E. However, the deformation of the legs L is such that they do not engage the tape T. The side punches continue their operation so that after the first ram 2 reaches the forward end of its movement, the legs L of the element E are squeezed onto the tape T. Then the firstly explained steps of FIGS. 6A and 6B follow.

Various modifications may be made in the embodiment explained above. For example, it is possible to positively drive the first ram 2 by cams on both ways of its reciprocation to avoid a condition in which the force of the springs 30 is not enough for keeping contact between the cams 20 and the rollers 25*a* in a high speed operation, resulting in inaccurate reciprocal movement of the first ram 2. FIGS. 10 and 11 show an apparatus for achieving this purpose in which a first ram and an output drive shaft are designated by the same numerals used in the preceding embodiment. The output drive shaft 19 is provided with two identical cams 38 and a cam 39 disposed therebetween. The cams 38 and 39 engage rollers 40 and 41 rotatably mounted on the first ram 2, respectively. As the drive output shaft 19 rotates, the first ram 2 is driven backward by engagement between the cams 38 and the roller 40 and forward by engagement between the cam 39 and the roller 41. Since the cams 38 and 39 are independent as explained above, the curves of the cams can be selected so that they are optimum for the forward and backward movements of the first ram 2, respectively. Furthermore, the dwell times for the first ram at the end of its forward and backward movements may be selected independently. Furthermore, it is easy to decide the configurations of the cams so that there is no play between the cams 38 and the roller 40 and between the cam 39 and the roller 41 in any angular position of the output drive shaft 19. Similar constructions for driving reciprocable members positively in the both ways may be used at will for the actuating members other than the first ram 2.

Figure 12:
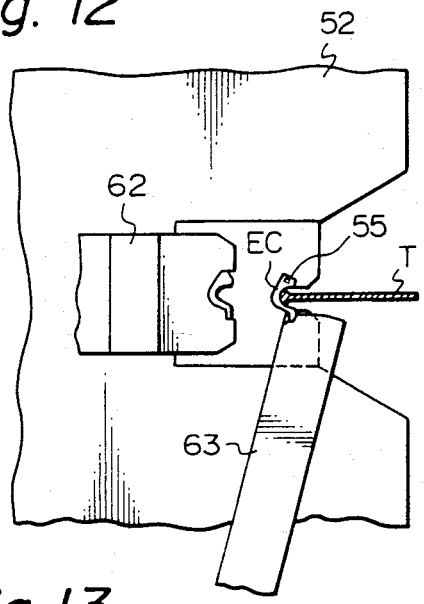
FIG. 12 is a plan view of an arrangement for planting an element of a concealed fastener according to another embodiment of the invention.
Figure 13:
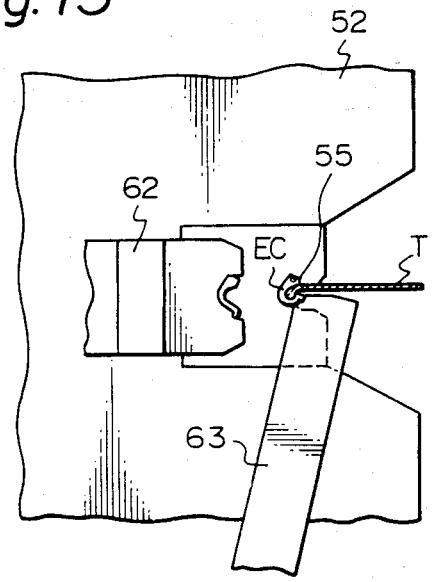
FIG. 13 is a plan view similar to FIG. 12 in which a side punch is actuated to plant the element.

FIGS. 12 and 13 show another embodiment in which the invention is applied to a concealed fastener. It shall be appreciated that the components not shown in these drawings are the same as the corresponding ones in the preceding embodiment. The configuration of the element EC is such that it has only one leg. Accordingly, only one side punch 63 is provided. The mechanism for reciprocating the side punch 63 is similar to the corresponding one in the preceding embodiment. However, the operation timing and the stroke of the mechanism are changed according to the configuration of the element EC. Such change can be done by adjusting only the driving mechanism for the side punch 63 without affecting the other mechanisms since the driving mechanisms for the actuating members are independent. A forming die 55 provided in a first ram 52 is formed to have a deep cavity so that as the element EC is clamped on the tape T by the side punch 63 as shown in FIG. 13, the die 55 holds the head portion of the element EC against the force imparted from the side punch. A cutting punch 62 is shaped to facilitate cutting the element EC.

For making the relation among the cams variable in either embodiment, it is possible to adapt the cams so that they are rotatable relative to the output drive shaft and can be fixed thereto at any angular position. Alternatively, it is possible to replace the output drive shaft with one having cams in a different arrangement.

What is claimed is:

1. A high speed apparatus for forming and planting slide fastener elements comprising: a first ram mounted on a frame for reciprocal movement and having at the forward end thereof a cutting die provided with a passage for a wire to be used for fastener elements extending therethrough and a forming die for forming an engageable head in each element; a cutting punch placed on the upper surface of the first ram for relative movement between the cutting punch and the first ram so that the cutting punch cuts out each element having at least one outwardly extending leg from the wire as the first ram moves backward; a forming punch for forming the engageable head placed above the first ram so that it aligns with the forming die when the first ram is at the end of its backward movement; and a side punch means for engaging the at least one leg of each element and deforming it inward for planting the fastener element on a fastener tape, characterized in that the apparatus includes an output drive shaft having first ram drive cam means, forming punch drive cam means and side punch drive cam means; cam follower mechanisms connecting said cam means to the first ram, the forming punch and the side punch means, respectively; a second ram to which said forming punch is connected, said second ram being mounted for reciprocal movement in the direction perpendicular to the movement of the first ram and adapted to be actuated by the cam follower mechanism for the forming punch, said first ram drive cam means being so shaped that the first ram dwells for a predetermined time at the end of each forward and backward movement, the shapes of said cam means and their mutual relation being so selected that the side punch means engages and holds the at least one leg of the element during the dwell at the end of the backward movement of said first ram, begins deformation of the at least one leg during the forward movement of said first ram, and plants the at least one leg on the fastener tape when said first ram is at the end of its forward movement and the forming punch is actuated during the dwell at the end of the backward movement of said first ram.

2. The apparatus of claim 1, further comprising a spring means for biasing the first ram in one direction of reciprocal movement and said cam follower mechanism for the first ram including a roller bearing against said first ram drive cam means by the effect of said spring means so that there is no play between said roller and said first ram drive cam means during the reciprocal movement of the first ram.

3. The apparatus of claim 1, wherein said first ram drive cam means includes two cam members and said cam follower mechanism for the first ram includes two rollers respectively contacting said cam members at opposite sides of said output drive shaft so that there is no play between said rollers and said first ram drive cam means during the reciprocable movement of the first ram.

* * * * *